US006644653B1

(12) United States Patent
Rossi et al.

(10) Patent No.: US 6,644,653 B1
(45) Date of Patent: Nov. 11, 2003

(54) DAMPING CORRUGATOR ROLL

(75) Inventors: Giuliano Rossi, Lesmo (IT); Giancarlo Scenini, Monza (IT); Raffaele Giove, Arcore (IT)

(73) Assignee: Agnati S.p.A., Vimercate (IT)

( * ) Notice: Subject to any disclaimer, the term of this patent is extended or adjusted under 35 U.S.C. 154(b) by 0 days.

(21) Appl. No.: 10/129,320

(22) PCT Filed: Nov. 2, 2000

(86) PCT No.: PCT/EP00/10795

§ 371 (c)(1),
(2), (4) Date: Jul. 24, 2002

(87) PCT Pub. No.: WO01/32410

PCT Pub. Date: May 10, 2001

(51) Int. Cl.[7] ..... B65H 29/70

(52) U.S. Cl. ..... 271/188; 492/5; 492/7; 492/16; 492/20

(58) Field of Search ..... 271/188; 492/5, 492/7, 16, 20, 57, 60; 29/116.1, 129.5, 113.1

(56) References Cited

U.S. PATENT DOCUMENTS

| | | | | | |
|---|---|---|---|---|---|
| 3,622,059 | A | * | 11/1971 | Savela | 226/190 |
| 3,757,398 | A | * | 9/1973 | Urban | 492/7 |
| 4,760,631 | A | | 8/1988 | Brendel | |
| 4,848,119 | A | * | 7/1989 | Pav et al. | 72/13.3 |
| 4,913,051 | A | * | 4/1990 | Molinatto | 101/376 |
| 5,075,943 | A | * | 12/1991 | Brendel et al. | 492/5 |
| 5,081,759 | A | | 1/1992 | Schiel | |
| 5,484,370 | A | * | 1/1996 | Jenke et al. | 492/4 |
| 5,487,715 | A | | 1/1996 | Schiel | |
| 5,853,359 | A | * | 12/1998 | Grabscheid et al. | 492/7 |
| 5,996,775 | A | * | 12/1999 | Hendrickx | 198/780 |
| 6,155,319 | A | * | 12/2000 | Giugliano et al. | 156/471 |

FOREIGN PATENT DOCUMENTS

| | | |
|---|---|---|
| EP | 0890429 | 1/1999 |
| GB | 1036922 | 7/1966 |

* cited by examiner

*Primary Examiner*—Donald P. Walsh
*Assistant Examiner*—Kaitlin Joerger
(74) *Attorney, Agent, or Firm*—James Creighton Wray; Meera P. Narasimhan

(57) ABSTRACT

A damping corrugator roll comprises an outer toothed surface, whose teeth extend over a certain axial length of the roll (2), support means (202) allowing rotation about the axis of the roll, and rotary drive means (1), characterized in that it comprises a cylindrical core which is supported for free rotation at its ends, and whereon a toothed peripheral cylindrical jacket is supported by and interposed or bearing material.

22 Claims, 6 Drawing Sheets

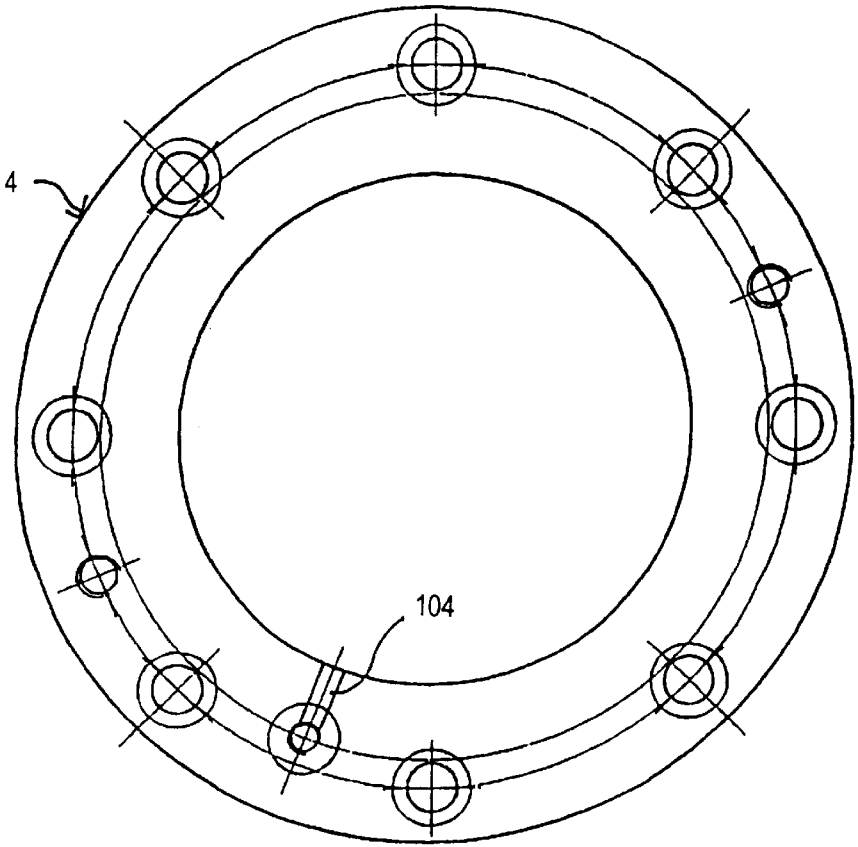
FIG. 5
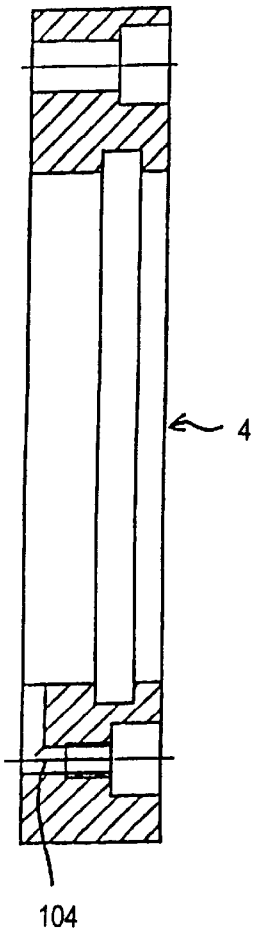

DAMPING CORRUGATOR ROLL

This application claims the benefit of Italian Application No. SV99A000036 filed Nov. 5, 1999 and PCT/EP00/10795 filed Nov. 2, 2000.

BACKGROUND OF THE INVENTION

The invention relates to a damping corrugator roll, comprising an outer toothed surface, whose teeth extend over a certain axial length of the roll, support means allowing rotation about the axis of the roll, and rotary drive means.

The invention particularly relates to a corrugator roll of the above type, provided in combination with an upper corrugator roll, parallel and tangent to said lower roll, both rolls being part of a corrugator unit for paper sheets, in corrugated board fabrication.

As a rule, the upper corrugator roll has a greater diameter and is rotatably driven, but it also has peripheral skirt teeth, whereby it meshes with the teeth of the lower corrugator roll, which runs idle and is rotatably dragged along by the upper corrugator roll.

In prior art machines, a severe problem is the very high level of noise generated by the corrugator unit. This noise is caused by the generation of vibrations and oscillations, mainly in the lower corrugator roll, which, according to current manufacturing trends, is smaller than the upper corrugator roll, hence more exposed to the excitation of vibrations.

There may be different kinds of vibrations, i.e. they may depend on flexures transverse to the axis of rotation, or on torsional flexures, i.e. in the circumferential direction with respect to the axis of the roll. Vibrations also depend of the shape of the corrugator teeth of the two rolls which, in combination with the paper feed, cause the vibratory motion of the roll. Due to the considerable axial lengths of rolls, the vibratory and/or oscillatory effects are particularly felt in the center part of the roll, i.e. far from the support constraints at the ends thereof. Also, in this center part, the vibratory and/or oscillatory effects are relatively out of control and dependent on the features of the processed paper.

Prior art damping means can absorb or damp at least part of the vibrations at the end constraints of the lower corrugator roll, but definitely cannot handle neither systematic nor casual oscillations or vibrations (the latter due to modified features of the paper being processed) at the center part of the corrugator roll. Therefore, a relatively poor damping effect is always obtained, whereby to date a still high level of noise is generated by corrugator units, such that it requires expensive and complex acoustical treatments on machines.

Moreover, vibrations and/or oscillations cause functional problems, such as the need to limit the production rate because the poor vibration dampening causes a loss of attachment between the layers of the corrugated board and a smaller flute width.

SUMMARY OF THE INVENTION

The invention has the object to provide a damped, particularly lower corrugator roll, so that, by simple and relatively inexpensive arrangements, the drawbacks of prior art rolls can be obviated, by effectively damping the generation of vibrations and/or oscillations, hence by drastically reducing the noise effect and the functional drawbacks due to poor damping.

The invention achieves the above objects by providing a corrugator roll as described hereinbefore, comprising:

A cylindrical core which is supported for free rotation at its ends and whereon a toothed peripheral cylindrical jacket is supported in a floatable manner by an interposed or bearing material.

The bearing or interposed material may consist of a fluid, such as a gas, a liquid, a highly viscous liquid or, for instance, having a pasty consistency, or of a solid material having a highly hysteretic elastic behavior.

The characteristics of the gaseous, liquid or pasty fluid shall be such that the friction coefficient of said materials with respect to the surfaces in contact therewith, that is the outer skirt of the core and the inner skirt of the floating jacket, will increase as the relative speed between the floating jacket and the cylindrical core increases.

The interposed or bearing fluids may be provided under pressure, at atmospheric pressure, or in conditions of negative pressure with respect to external atmospheric pressure. This depends on the conditions of use.

It may be also provided that the jacket and the cylindrical core form, e.g. by using rotary sealing heads, a sealed hollow space wherein the interposed material is introduced and replaced from time to time after a predetermined number of operating hours.

Alternatively, the sealed hollow space formed by the tubular cylindrical jacket and by the cylindrical core may have inlets and outlets for automatic feeding of or filling up with the interposed material, in this case fluid, or for generating a continuous or batch circulation of said fluid, which can provide balanced dynamic conditions in the hollow space as regards pressure and quantity of fluid. At the same time, the circulation of fluid ensures a constant renewal thereof, for instance with respect to the maintenance of a predetermined temperature or of a predetermined mixture composition or condition, or of any other parameter that can be affected by the use and restored by service treatments.

Advantageously, the sealing means at the heads of the tubular toothed cylindrical jacket are such that they allow, by using yielding members, the jacket to be moved at least transverse to the core.

The cylindrical jacket has lower weight and inertia values as compared with the central core.

Depending on the length, the length to diameter ratio of the lower roll, i.e. of the jacket of the lower roll is higher than 10. The jacket shall be relatively thin, but anyway have a sufficient thickness to allow paper processing.

As a rule, the diameter to thickness ratio is of 8/1 to 15/1, preferably of about 10/1.

For diameters and lengths commonly used in corrugator machines, the thickness of the jacket may range from 10 to 100 mm, particularly from 20 to 50 mm, preferably from 25 to 35 mm.

The hollow space or chamber, or the difference between the outside diameter of the core and the inside diameter of the jacket is of 0,1 to 5 mm, also depending on the diameter and length of the jacket as well as on the type of interposed material.

The outer jacket can be made of any suitable material, also composite or in two, three or more layers.

For instance, the material to be used can be steel or other metals, preferably after undergoing hardening treatments, such as quenching or coating with hard layers, e.g. made of tungsten carbide, hard chromium or titanium nitrides.

The invention is based on the acknowledgement that, during operation, the vibrations in the floating jacket cause variations in the bearing thickness (thickness of the hollow space between the floating jacket and the cylindrical core), hence in the bearing fluid. Bearing thickness deformations cause variations in the relative speed of the filling or bearing material, hence variations in the friction coefficient, which have the effect of damping the motions and stresses that generate vibratory motions.

The arrangement according to the invention leads to unexpected advantages in combination with bthe toothed corrugator rolls. An effectively damping lower corrugator roll is the most appetizing and required thing in the field. A drastic reduction of the noise generated by vibrations would allow to reduce economic and construction efforts for acoustical treatments. Yet, the floating suspension of the lower corrugator roll does not require to account for the specificity of shapes or profiles of the corrugator teeth, since such floating suspension allows a wide adaptability to the teeth shapes, as regards both noise generation and functional effectiveness of the corrugator unit. More particularly it has to be noted that the teeth of corrugator rolls cooperating with each other are not designed to lead to a homocinetic kind of motion. This means that the way two corrugator rolls cooperate with each other is not similar to the way as two gears cooperate with each other, since the teeth are designed in order to corrugate sheets of paper without damaging the paper. The corrugator rolls are affected not only by vibration modes due their own motion but also by vibrations which are induced by the teeth and the paper being treated. The bearing fluid or material interposed between the core of the roll and the toothed jacket has shown a high speed of reacting to the induced vibrations thus leading to an effective damping of the vibrations which was unexpected in the technical field on the light of the actual knowledge.

Further unexpected advantages consist in the fact that the bering fluid or material leads to a uniform distribution of the pressure exerted by the corrugator roll over its entire length. This effect allows to avoid particular shaping of the corrugator roll with respect to a cylindrical form. Furthermore, the supports at the ends of the corrugator roll are less stressed than in then case of the known corrugator rolls. Thanks to the above advantages also the frequency of regeneration of the corrugator rolls is reduced, lowering costs for the manufacturers and obviating to have a production line stopped for longer time. It has to be noted that corrugator rolls are very large and big so that it is not quite simple to send the rolls back to the manufacturer for regeneration. Also the regeneration treatment is expensive and time consuming.

A particular advantage appears applying the contruction of the corrugator roll according to the present invention in combination with a corrugator unit, particularly for sheets or webs of paper, or similar, of the type comprising at least two rolls having a toothed or corrugated surface and being mutually engaged and pushed against each other by a predetermined pressure or force, the mutual compression between rolls being exerted over the whole axial length of the rolls through mechanical or magnetic means as described in EP 98112227.8.

In this case a cradle made of a series of several wheels or belts. Particular advantages results in a corrugator unit of the above mentioned kind in which one of the at least two corrugator rolls has a smaller diameter than the other roll.

The damping effectiveness obtained by the roll according to the invention also allows to improve the functionality of the corrugator unit, e.g. with reference to the possibility of increasing the corrugated board production rate, without incurring in manufacturing defects, such as gluing defects and/or variations in flute width.

The invention also relates to further improvements, which form the subject of the dependent claims.

The characteristics of the invention and the advantages derived therefrom will appear more clearly from the following description of a non-limiting embodiment, illustrated in the annexed drawings, in which:

DESCRIPTION OF THE DRAWINGS

FIG. 5 is an axial sectional view of the sealing heads of the cylindrical jacket.

DETAILED DESCRIPTION OF THE PREFERRED EMBODIMENTS

Figure 1:
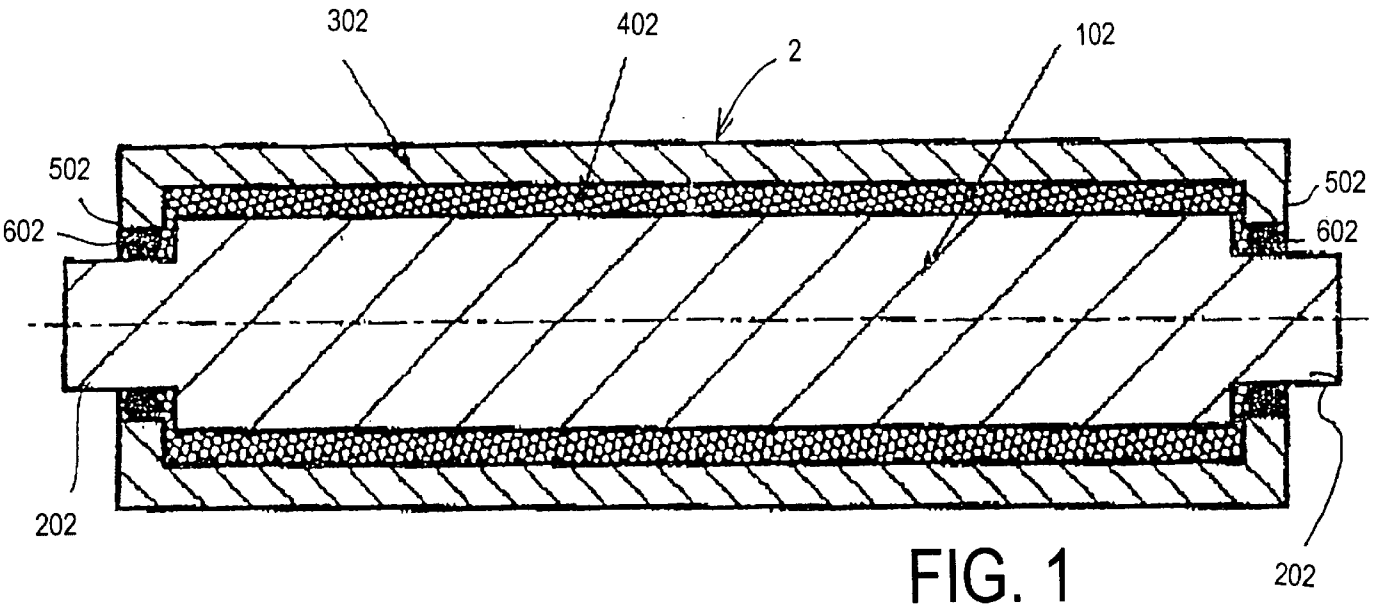
FIGS. 1 and 2 are a schematic axial sectional view and a schematic transverse sectional view respectively of a roll according to the invention.
Figure 2:
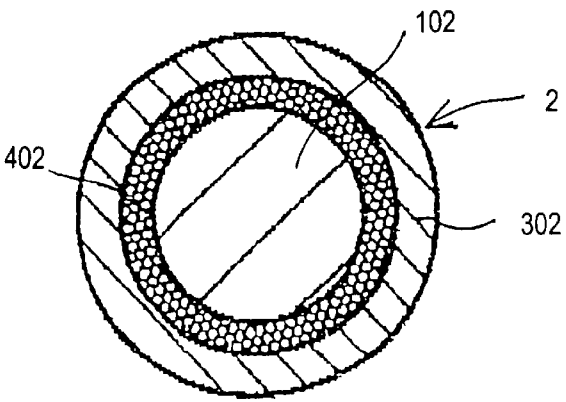
Figure 7:
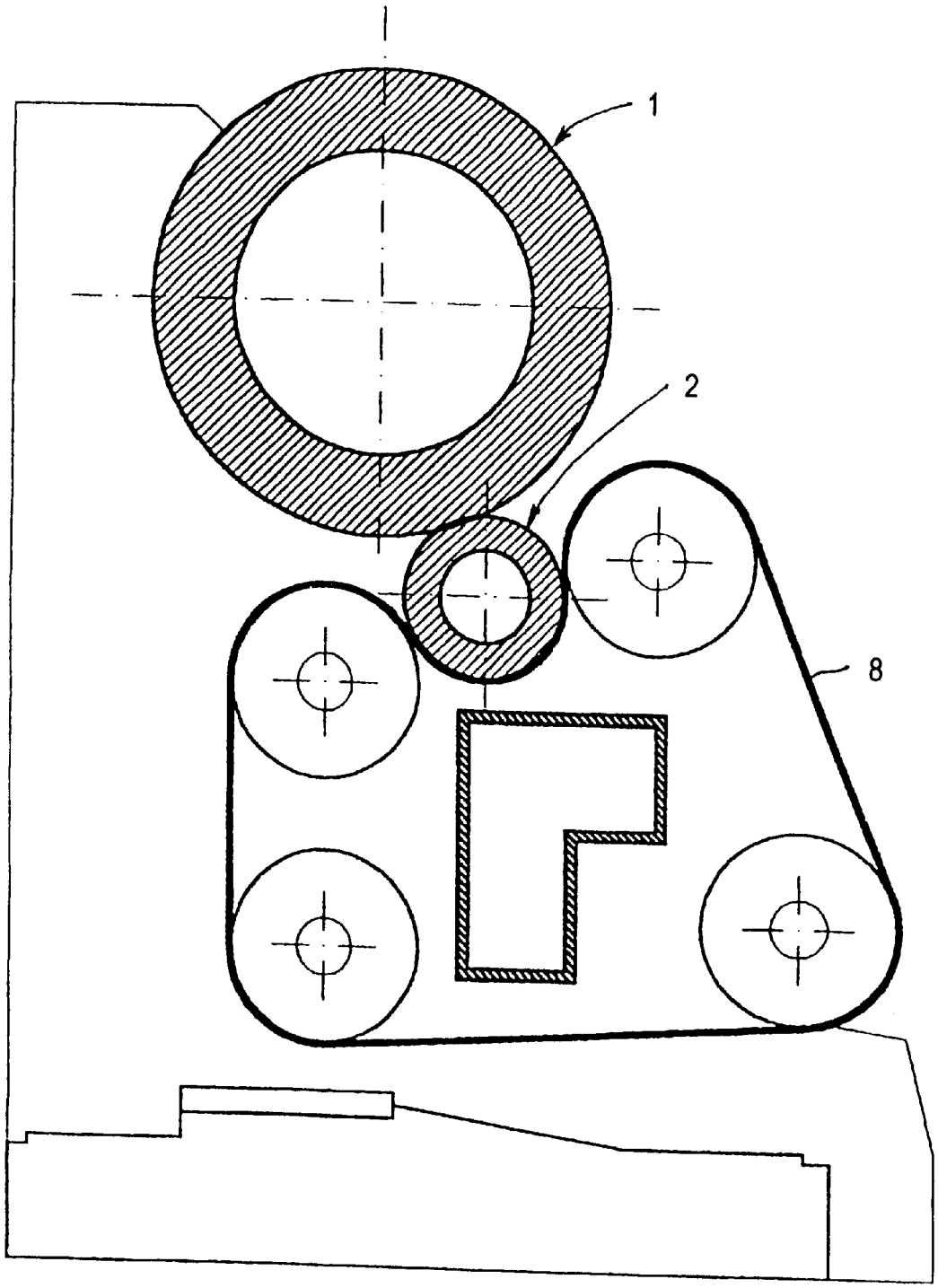
FIG. 7 shows a general corrugator unit with a pair of toothed rolls, an upper and a lower roll.

Referring to FIGS. 1, 2 and 7, a corrugator unit comprises a pair of peripherally toothed meshed corrugator rolls 1 and 2. One corrugator roll, the upper one 1, has a relatively great diameter and is rotatably supported and driven at its ends. The second corrugator roll, the lower one 2, has a considerably smaller diameter and is supported in a pressure cradle, composed of belts, pairs of rollers, or else. The lower corrugator roll 2 is pushed with a predetermined force against the upper corrugator roll 1.

FIGS. 1 and 2 are very schematic views of the construction principle of the lower corrugator roll according to the present invention. This roll consists of a cylindrical core 102, which has rotary support extensions 202 at its ends, whereby the cylindrical core 102 is mounted for free rotation onto the support frame, for instance of the corrugator unit. The cylindrical core 102 is held inside a cylindrical jacket 302, whose inside diameter is greater than the outside diameter of the cylindrical core, thereby forming a cylindrical hollow space 402 between said two parts. In principle, the hollow space cannot be closed at the end sides. Further, if the jacket 302 has partial or complete heads 502 through which the extensions 202 for support of the cylindrical core 102 extend, then these heads shall be elastically coupled to the core supporting extensions 202, i.e. so that the tubular cylindrical jacket 302 can move transverse to the cylindrical core, at least within the limits of the order of magnitude of the vibrations to be damped. This is shown by the elements denoted with numeral 602.

The hollow space 402 can simply contain air at atmospheric pressure, or at different over- or underpressures, or mixtures of gases, liquid fluids or mixtures of liquid fluids, having different, preferably high viscosity values, or highly viscous, or pasty materials, such as fat, or the like.

Liquid fluids may include water, oil, mixtures of water and oil, plastic polymers in liquid form, and any type of liquid having the physical characteristics fit for the purpose.

Alternatively, the space 402 can be filled with a solid plastic material of the elastic type, particularly having a highly hysteretic elasticity.

The fluid materials held in the hollow space 402 preferably have such characteristics as to generate friction coupling between the jacket 302 and the core 102, the friction coefficient being such that it increases as the rotation speed difference between the core and the jacket increases.

Then, the tubular jacket 302 rotates freely around the core, substantially floating on an intermediate bearing layer. The jacket is rotatably driven by the upper corrugator roll 1 against which it is pushed, for instance by the belts 8. The core is also rotatably dragged along by the jacket, by being coupled thereto through the fluid or solid bearing substance. The rotation of the core is necessary for the storage of a sufficient inertia, which would not be possessed by the jacket alone. Inertia is required to ensure that the motion conditions of the jacket are as independent as possible from small variables of the product or operating conditions.

The fluid or other mass provides the translation of the jacket vibrations into local variations of width of the hollow space and hence into local variations of speed or local gradients of speed, which locally generate an increase of friction, hence the absorption of the energy caused by vibrations, whereupon the latter are at least partially damped.

The cylindrical core 102 is generally made of solid steel. The jacket may be made of steel or of any other metal, preferably after undergoing surface hardening treatments, such as quenching or coating with layers of a hard material, e.g. tungsten carbide, hard chromium, etc. and/or titanium nitrides.

The thickness of the jacket varies with its diameter, the latter being subject to restrictions based on the length. Generally, with length to diameter ratios higher than 10, the diameter to thickness ratio of the jacket is of 8:1 to 15:1, particularly of 10:1. For usual roll lengths, thickness may range from 10 to 100 mm, particularly from 20 to 50, especially from 25 to 35 mm.

The hollow space must not be excessively thick. It can have a thickness of 0.1 to 5 mm.

Figure 3:
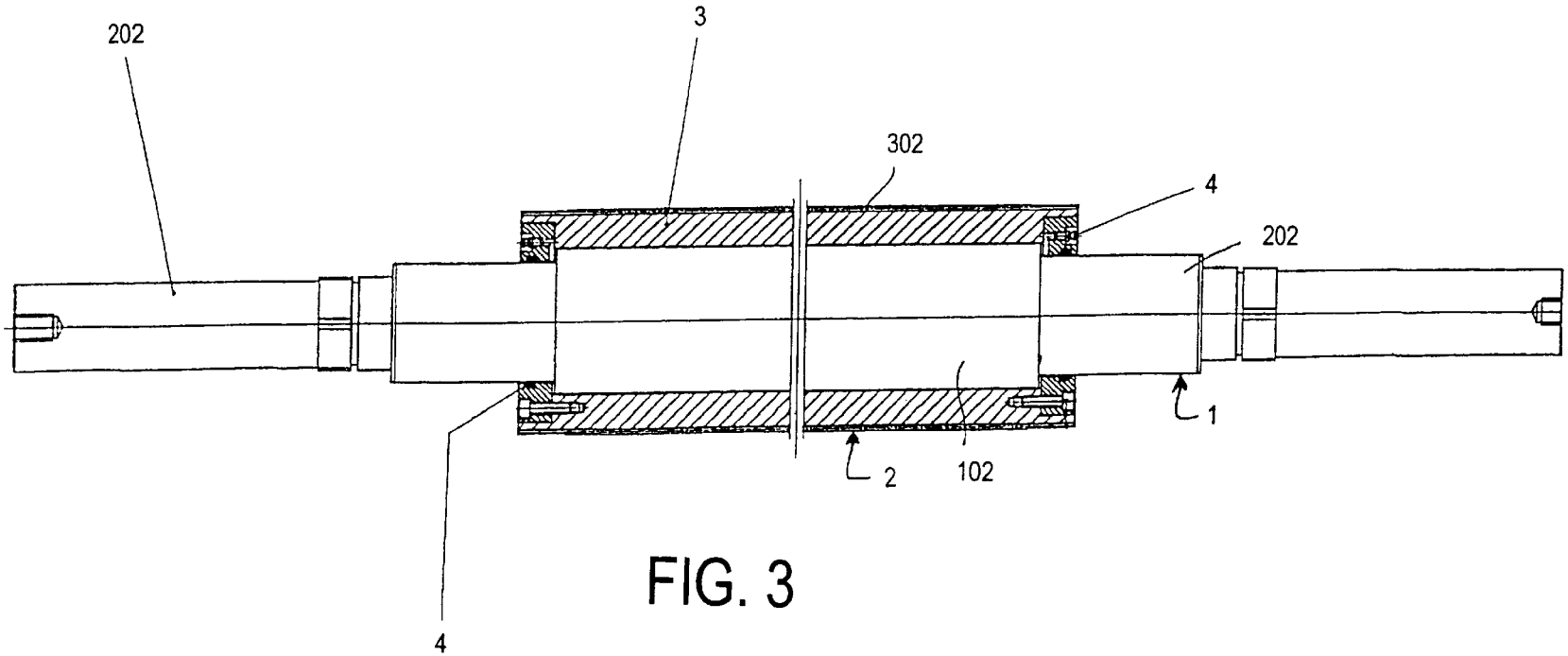
FIG. 3 is an axial sectional view of an embodiment of a roll according to the invention.
Figure 4:
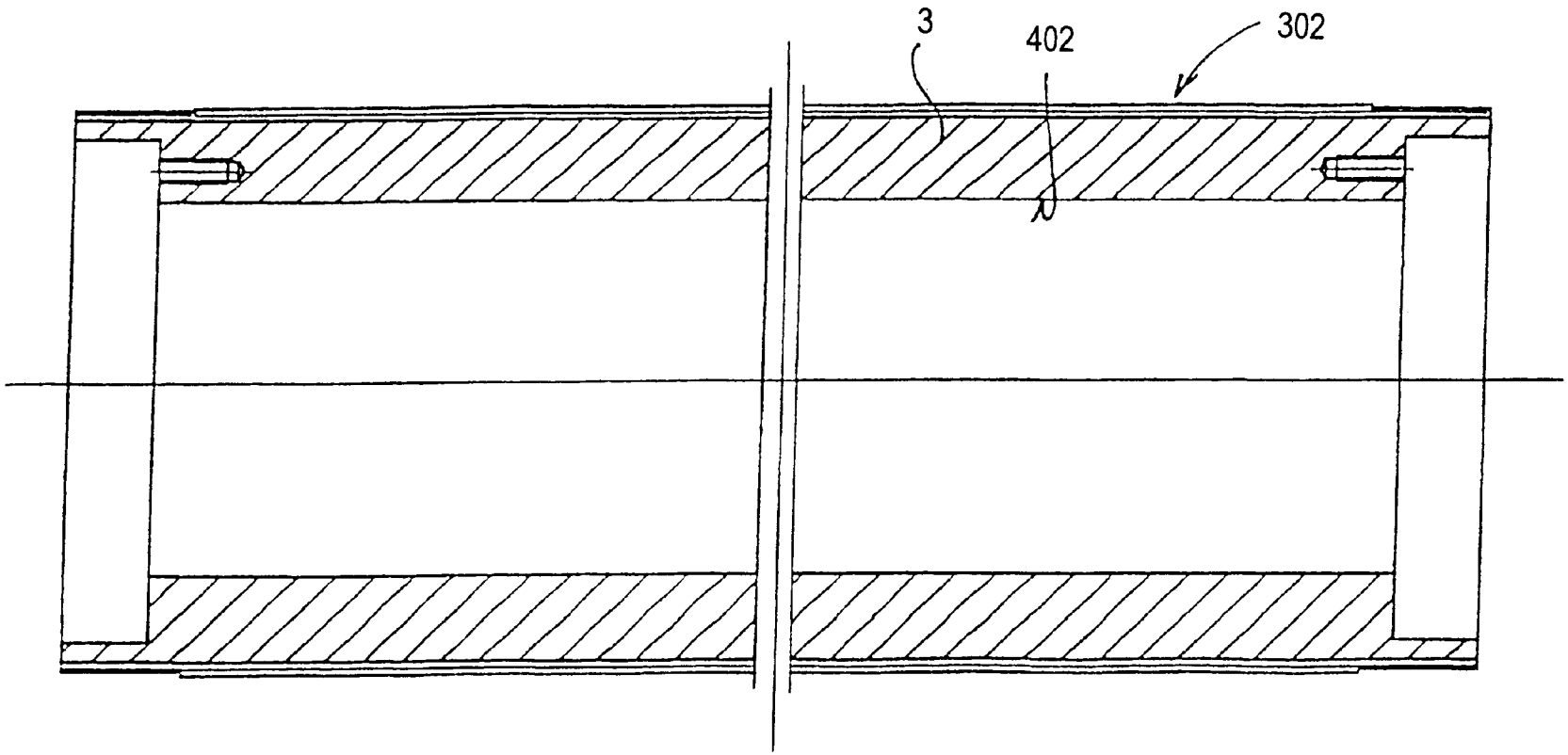
FIG. 4 is an axial sectional view of the outer toothed cylindrical jacket.
Figure 6:
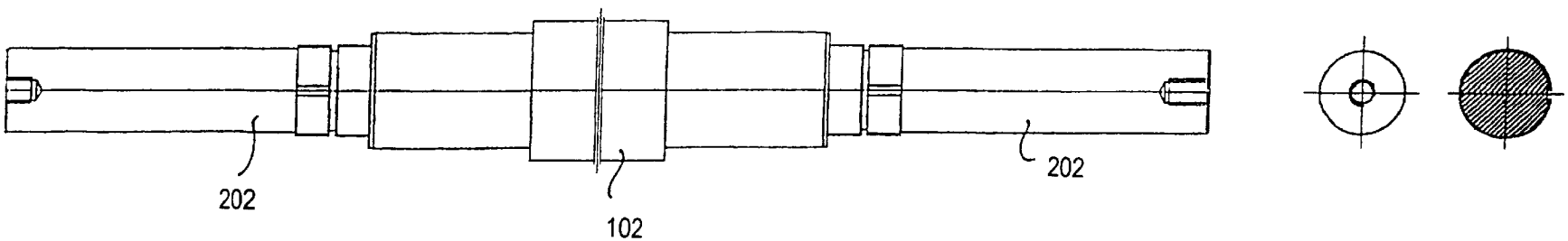
FIG. 6 is a view of the cylindrical core.

With reference to FIGS. 3 to 5, a definitely non-limiting construction embodiment of the invention concept is shown.

The cylindrical core 102, with the extensions 202 thereof, is slipped into a jacket element 302, which has an inner layer 3 made of a highly hysteretic elastic plastic material. Said material is preshaped to hold the heads 4 for rotatably sealing the jacket, while allowing transverse staggering movements.

Advantageously, the layer 3 at the heads of the jacket 302 may have a recess for housing the sealing heads 4, which are properly positioned and locked therein with the desired sealing effect. These heads have no support function on the jacket 302 but are only used to contain substances, fluids or liquids held in the hollow space.

The inner plastic layer 3 can have the function of directly damping vibrations.

In combination with said plastic layer and the core 102, a hollow space may be provided which is filled with air or another fluid, particularly with a viscous liquid.

In this case, the elastic or viscous vibration absorption behavior may be calibrated by combining two or more layers for bearing the jacket 302.

The layer 3 may also be made of metal while the hollow space alone may be filled with the bearing fluid.

As shown in the figures, and particularly in FIGS. 3 and 5, the heads 4 may have in this case inlets and/or outlets 104 for the bearing and/or interposed fluid. These can be simply used for occasionally filling and/or topping up the hollow space 402 with the bearing fluid. Alternatively, the fluid may be made to permanently circulate between a storage tank and the hollow space, thereby allowing adjustment of the physical and/or composition parameters of the fluid, e.g. by adjusting temperature when the roll is in use.

Obviously, the illustrated constructions are not intended to restrict the previously disclosed principle of the invention and can be extended to further types of rolls, both for board production industry and for other sectors, having equal problems.

What is claimed is:

1. A damping corrugator roll comprising a cylindrical core and a relatively thin coaxial tubular cylindrical jacket having an outer toothed surface and rotatably supported in a floatable manner on the cylindrical core by an interposed or bearing material which fills a hollow space provided between the cylindrical core and the cylindrical jacket, wherein:

a) the cylindrical core is rotatably supported at its ends;

b) the interposed bearing material is a fluid material with high viscosity values, or a solid material with a highly hysteretic elastic behavior; and c) friction of the interposed bearing material with respect to the outer skin of the cylindrical core and with respect to the inner skirt of the cylindrical jacket increases as the relative speed between the jacket and the core increases.

2. A roll as claimed in claim 1, wherein the bearing or interposed material may consist of a fluid, such as a gas, a liquid, or, for instance in the form of paste, of a solid material.

3. A roll as claimed in claim 1, wherein the characteristics of the gaseous, liquid or pasty fluid shall be such that the friction of said materials with respect to the surfaces in contact therewith, that is the outer skirt of the core and the inner skirt of the floating jacket, will increase as the relative speed between the floating jacket and the cylindrical core increases.

4. A roll as claimed in claim 1, wherein the interposed or bearing fluids may be provided at atmospheric pressure, under pressure, or in conditions of negative pressure with respect to external atmospheric pressure.

5. A roll as claimed in claim 1, wherein it may be provided that the jacket and the cylindrical core form, e.g. by using rotary sealing heads, a sealed hollow space wherein the interposed material is introduced and may be replaced after a predetermined number of operating hours.

6. A roll as claimed in claim 1, wherein, alternatively, the sealed hollow space formed by the tubular cylindrical jacket and by the cylindrical core may have inlets and outlets for automatic feeding of or filling up with the interposed material, in this case fluid, or for generating a continuous or batch circulation of said fluid, which circulation is controlled so that it can generate balanced dynamic conditions in the hollow space as regards pressure and quantity of fluid.

7. A roll as claimed in claim 1, wherein, in combination, it comprises means for circulation of the bearing or interposed fluid and means for constant or batch renewal and/or conditioning of said fluid e.g. with respect to the maintenance of a predetermined temperature or of a predetermined composition or condition of the fluid components.

8. A roll as claimed in claim 1, wherein the means for sealing the heads of the tubular toothed cylindrical jacket are such that they allow, by using yielding members, the jacket to be moved at least transverse to the core.

9. A roll as claimed in claim 1, wherein the cylindrical jacket has lower weight and/or inertia values as compared with the central core.

10. A roll as claimed in claim 1, wherein depending on the length, the length to diameter ratio of the lower roll, i.e. of the jacket of the lower roll is higher than 10.

11. A roll as claimed in claim 1, wherein the jacket is relatively thin, but anyway has a sufficient thickness to allow paper processing.

12. A roll as claimed in claim 1, wherein the ratio of the diameter of the roll to the thickness of the jacket is of 8/1 to 15/1, preferably of about 10/1.

13. A roll as claimed in claim 1, wherein the hollow space or chamber, or the difference between the outside diameter of the core and the inside diameter of the jacket is of 0.1 to 5 mm, also depending on the diameter and length of the jacket as well as on the type of interposed material.

14. A roll as claimed in claim 1, wherein it can be made of any suitable material, even composite or composed on one, two, three or more layers.

15. A roll as claimed in claim 14, wherein the material to be used can be steel or other metals, preferably after undergoing hardening treatments, such as quenching or coating with hard layers, e.g. made of tungsten carbide, hard chromium or titanium nitrides.

16. A roll as claimed in claim 1, wherein the hollow space may be filled with one, two or more layers of interposed or bearing material, which form a combined filling.

17. A roll as claimed in claim 1, wherein both the jacket and the material for filling the hollow space are double-, triple-, or multilayer.

18. A roll as claimed in claim 1, wherein it is provided in combination with another corrugator roll, whereto it is tangent, while said other roll meshes by its peripheral teeth with the peripheral teeth of the roll, said two rolls being part of a corrugator unit for fabricating corrugated board.

19. A roll as claimed in claim 1, wherein it has no outer toothing and/or it is not part of the corrugator unit.

20. A damping corrugator roll according to claim 1, wherein it is provided in combination with a corrugator unit, particularly for sheets or webs of paper, or similar, of the type comprising at least two rolls having a toothed or corrugated surface and being mutually engaged and pushed against each other by a predetermined pressure or force, the mutual compression between rolls being exerted over the whole axial length of the rolls through mechanical or magnetic means and in which one of the corrugated rolls is a corrugator roll according to claim 1.

21. A corrugator roll according to claim 20, wherein it is supported by a cradle made of a series of several wheels or belts, the wheels or the belts being provided in combination with means for regulating the force exerted on the corrugator roll against the cooperating corrugator roll.

22. A corrugator roll according to claim 20, wherein it has a smaller diameter than the other corrugator roll with which it cooperates.

* * * * *